US006349415B1

(12) United States Patent
Gong

(10) Patent No.: US 6,349,415 B1
(45) Date of Patent: Feb. 26, 2002

(54) COLLAPSIBLE BASEBALL CAP

(76) Inventor: Clifford Gong, 8170 Mountain View Dr. Apt. E, Pleasanton, CA (US) 94588

( * ) Notice: Subject to any disclaimer, the term of this patent is extended or adjusted under 35 U.S.C. 154(b) by 0 days.

(21) Appl. No.: 09/886,323

(22) Filed: Jun. 21, 2001

(51) Int. Cl.[7] ..... A42B 1/00
(52) U.S. Cl. ..... 2/195.5; 2/195.1; 2/175.4
(58) Field of Search ..... 2/195.1, 195.2, 2/195.5, 195.6, 175.1, 209.12, 175.4

(56) References Cited

U.S. PATENT DOCUMENTS 1,056,018 A * 3/1913 Foster ..... 2/10
1,946,998 A * 2/1934 Armstrong ..... 2/10
2,728,913 A * 1/1956 Connor ..... 2/10
5,406,645 A * 4/1995 Lin ..... 2/10
5,548,846 A * 8/1996 Biancheti ..... 2/209.12
5,845,339 A * 12/1998 Ashley et al. ..... 2/195.6

* cited by examiner

*Primary Examiner*—Bibhu Mohanty
(74) *Attorney, Agent, or Firm*—Pitney, Hardin, Kipp & Szuch LLP

(57) ABSTRACT

A baseball cap designed to be collapsible in order to be compact enough to conveniently fit in a shirt pocket or a pair of pants. A retractable element of the membrane in the frame of the cap allows the cap to return to its recognizable baseball shape, when the cap is not restricted in its compacted form.

20 Claims, 3 Drawing Sheets

COLLAPSIBLE BASEBALL CAP

BACKGROUND OF THE INVENTION

1. Field of the Invention

The invention is a collapsible baseball cap or a collapsible cap with a visor where the cap, by using a loop membrane, can be collapsed to a compacted shape where the shape is fittable in a shirt or pants pocket without the shape being unsightly. A retractable element of the membrane used within the frame of the cap allows the cap to return to its recognizable baseball cap shape when the cap is not restricted in its compacted shape.

2. Brief Description of the Prior Art

It is well known in the prior art that except when worn on one's head baseball caps are awkward to carry on one's person. The reason for this awkwardness is that the bill of the baseball cap is usually made of hard material and the general construction of the cap is semi-rigid in order to maintain the shape of the cap.

Numerous variations of hats have been developed in order to obtain a collapsible nature. Variations include either folding, twisting, or rolling up the hat into a compressed size. The structure of these variations differ from allowing a simple folding action to the complexity of a wire-like semi-flexible loop membrane sewn into the outer periphery of the crown of the hat.

In U.S. Pat. No. 5,845,339, an attempt is made to make a collapsible baseball cap using a loop of flexible material only with the bill of the cap. While this loop of flexible material can support the bill, the collapsing feature of the cap is similar to balling up a piece of fabric. This resulting ball of cap fabric makes the cap unsightly even if it were possible to fit the collapsed cap into a shirt pocket.

Hats that use a full loop membrane within the frame of the hat are intended to be twisted into two or three smaller loops, similar to collapsible auto shades that fold into small circles. However, use of a full loop membrane has not yet been able to be adapted for a baseball cap. The reasons for this are numerous. First, a full loop membrane used in a panama hat or in the auto shade described above does rot provide adequate support for the smaller and complex structure of a baseball cap. For example, in order for a hat to fit in a shirt pocket, it would have to be twisted several times. In the case of an autoshade, the membrane is constructed of a flat strip of metal. Because of its flat shape, the metal strip does not lend itself well to the re-application of folding itself into smaller form. If folding is attempted, the frame may be bent into a shape not recognizable as an autoshade.

Another reason for the inadequacy of the full loop membrane is that when resizing the baseball cap, a full loop membrane has a noticeable and varying impact on the structure of the bill of the cap. Also, in order to construct a frame adequate to accompany the full loop membrane, the frame would require welding, crimping or soldering metal pieces small enough to be used in a cap. Besides the inherent high cost associated with welding or soldering such small frames welded connection areas are more susceptible to breakage than the frame especially when the baseball cap is compacted or stowed away in a pocket.

It is seen from the foregoing that there is a need for a collapsible baseball cap which overcomes the disadvantages found in the prior art concerning structure, adjustability to size and durability of the frame when the cap is collapsed. Such a collapsible cap should be able to fit in a pocket either in the shirt or pants of the user.

SUMMARY OF THE INVENTION

It is therefore an object of the present invention to provide a collapsible baseball cap.

It is therefore a further object of the present invention to provide a collapsible baseball cap that when collapsed can fit in a shirt or hip pocket.

It is therefore a still further object of the present invention to provide a collapsible baseball cap that when collapsed does not appear unsightly when fit in a hip or shirt pocket.

It is therefore a still further object of the present invention to provide a collapsible baseball cap that automatically retracts to its original shape after its containment in compact form is removed.

It is therefore a still further object of the present invention to provide a collapsible baseball cap that can be contained by a device such as a zippered pouch or elastic band.

To attain the objects described, there is provided a collapsible cap in which adequate support in both the inner crown and the bill make it easy to twist the cap in several loops that it is small enough to fit into a shirt or pants pocket without being unsightly. A wire-like membrane is used to create support in both the crown and outer circle to support the bill. No glue, welding or soldering would be needed, if a single-wire membrane is used.

If the cap is folded or collapsed and containment of the compacted cap is removed, the retractable property of the membrane returns the cap to its original wearable shape. The cap can still be made resizable by crimping a small portion of the back of the cap to form an arch. This arch area would permit standard size adjustment devices such as a small elastic band or Velcro tabs to size the cap.

BRIEF DESCRIPTION OF THE DRAWINGS

Thus by the present invention its objects and advantages will be realized, the description of which should be taken in conjunction with the drawings wherein.

DETAILED DESCRIPTION OF THE PREFERRED EMBODIMENTS

Figure 1:
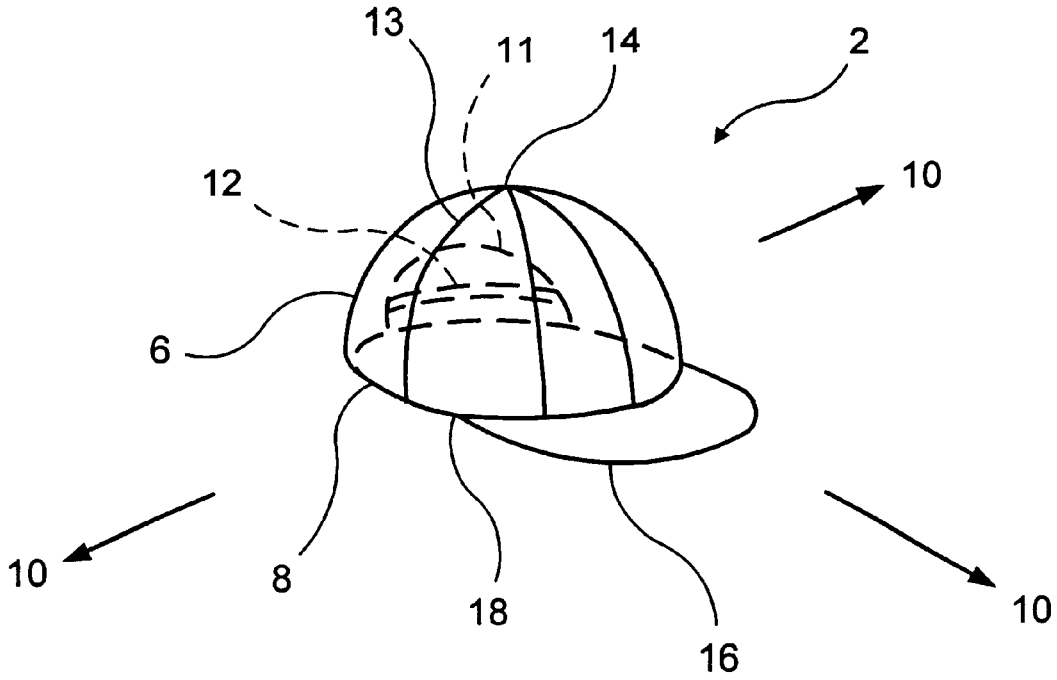
FIG. 1 is an isometric view of the collapsible cap.
Figure 2A:
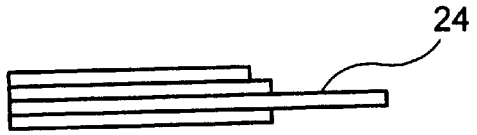
FIG. 2 is a depiction of the process for enclosing a single loop membrane into the baseball cap.
Figure 2B:
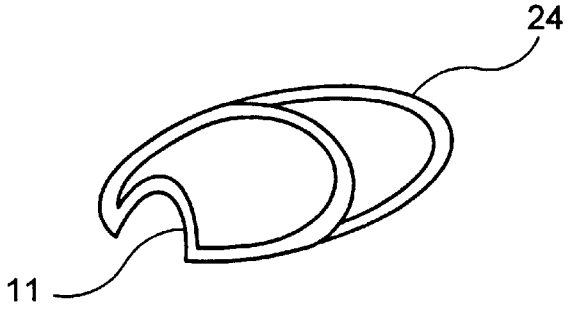
Figure 2C:
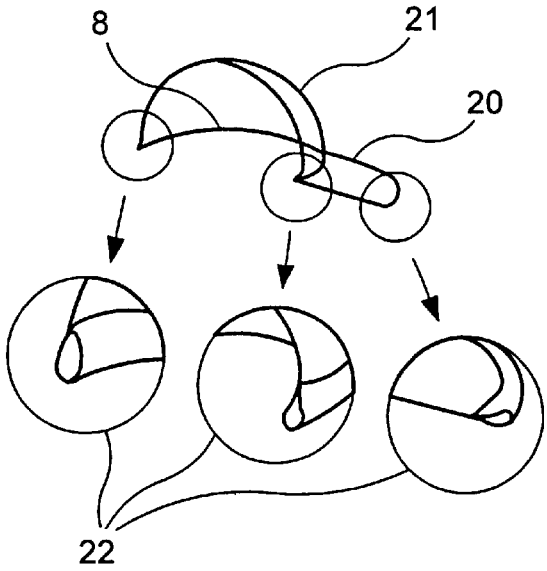
Figure 2D:
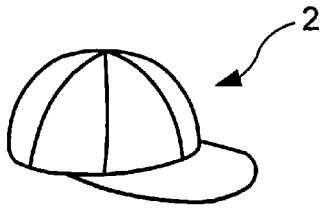
Figure 3H:
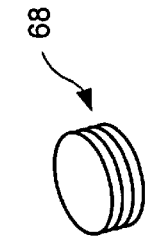
FIG. 3 is a depiction of the process to twist and fold the baseball cap into its collapsed state.
Figure 3D:
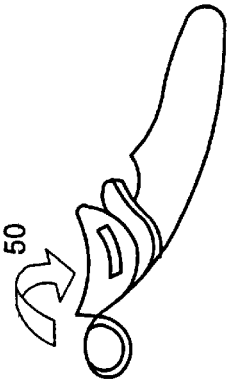
Figure 3E:
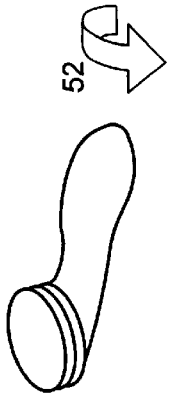
Figure 3F:
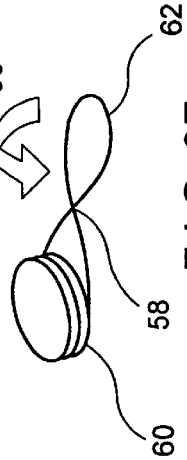
Figure 3G:
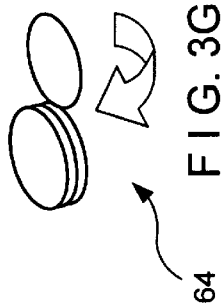
Figure 3A:
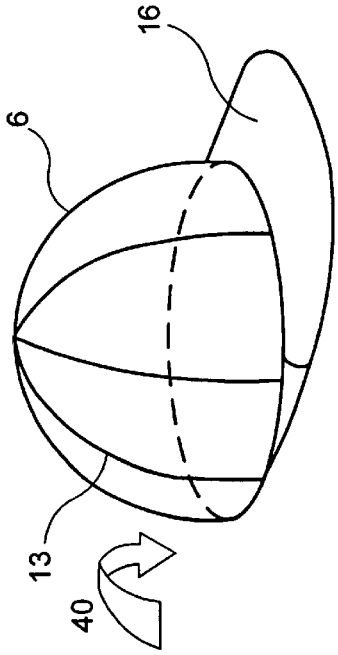
Figure 3B:
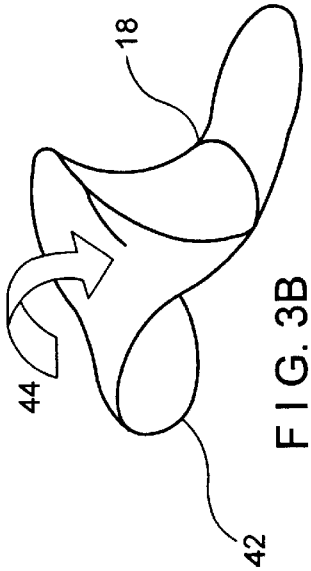
Figure 3C:
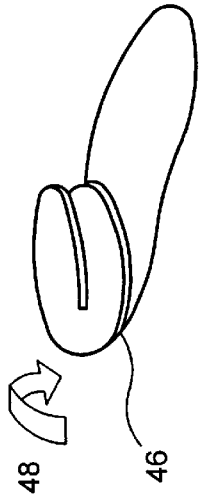

Referring now to the drawings wherein like numerals refer to like elements throughout the several views, one sees that FIG. 1 is an isometric view of the collapsible baseball cap 2 Cap 2 preferably has a material that is fabric-based; however, other suitable materials maybe used. Cap 2 is a structure comprising a crown 6 where the crown is a hollowed substantially half-spherical shape where the open circumference 8 is sized to fit a human head by being semi-flexible in directions 10.

In the rear structure of the cap is arch section 11. Arch section 11 is created by the crimping of loop membrane 24 (see FIG. 2). With fabric applied, arch section 11 allows for sizing of cap 2 with the use of adjustable strap 12 which is stitched to opposing sides of arch 12. Adjustable strap 12 is preferably made of VELCRO or any other material suitable for the purpose of adjustment. Crown 6 can be reinforced by seams 13 which run from circumference 8 to central stitching point 14. Seams 13 maintain the shape of crown 6 to resemble a cap. Sewn to or interwoven to an outer edge of circumference 8 is visor 16. Visor 16 is a thickened substantially parabolic shape; however, other shapes are possible and are known to those skilled in the art.

FIG. 2 depicts the process of enclosing single loop membrane 24 into cap 2. While a single loop membrane is depicted, two sections of loop membrane may be used (one section for circumference 8 and one section for visor 16). When two sections of loop membrane are attached by welding or soldering, they would comprise the features of a single loop membrane.

View A is a side view of membrane 24 in its flattened state. Single coiled type membrane 24 is preferably made of NITINOL; however, suitable alternatives may be used. The flexible spring-like and shape memory features of NITINOL allow membrane 24 to be collapsible yet retaining an ability to retract to a programmed shape. Because NITINOL has been used in manufacturing since the 1960's, it has been refined for use in lightweight products; therefore, ideally suited for baseball caps. In View B, membrane 24 is uncoiled and exposed to depict crimping of membrane 24 into a recognizable cap shape. Membrane 24 can also be crimped to size arch section 11 where arch section 11 would be a cap size adjusting area.

In an unstitched section shown by example but not limited to the magnified areas shown in View C, fabric 21 is positioned over membrane 24 such that all remaining fabric at circumference 8 or perimeter 20 is stitched where membrane 24 is now fully enclosed by the covering material of the cap. Fully formed cap 2 is shown in View D, where interior membrane 24 has retracted to its programmed state allowing cap 2 to resemble a recognizable baseball cap.

FIG. 3 depicts cap 2 being collapsed into its preferred compact embodiment, where cap 2 starts the process is in its recognizable baseball cap shape. Cap 2 is folded in direction 40 to result in crown 6 collapsed with seams 13 flattened to the plane of visor 16. Distal edge 42 of circumference 8 is twisted in direction 44 to form a figure-eight configuration and to forwardly align with cutaway area 18. Proximal side 46 is twisted inwardly in direction 48 toward the center of circumference 8. Before or at this point, the spiral semi-concentric shape of enclosed membrane 24 should be felt and any further folding End twisting of crown 6 contributes to this semi-concentricity, as shown in folding directions 50, 52.

As shown by direction 56, visor 16 is twisted at midsection 58 to form a figure-eight configuration of two substantially circular areas 60, 62. Circular areas 60, 62 are folded under each other in direction 64 to conform to the semi-concentricity of crown 6. Resultant collapsed form 68 is now sized to comfortably fit in a shirt, pants pocket, or can be contained by a device such as a zippered pouch or elastic. When unrestricted by a containment device or pressure applied by the user, the programmed shape of membrane 24 retracts from collapsed form 68 to cap 2; thus returning to its state as a recognizable baseball cap.

Thus by the present invention its objects and advantages are realized and although preferred embodiments have been disclosed and described in detail herein, its scope should be determined by that of the appended claims.

We claim:

1. A cap capable of being collapsed into a compacted form, wherein said cap comprises:

a hollow crown wherein said crown has a circumference forming a border for a material covering said cap;

a first seam where said material is folded over at the circumference and secured by said first seam forming a first channel along the circumference enclosing a first section of a loop membrane;

a visor in which a cutaway section of said visor is attached to said circumference;

a second seam wherein said material is folded over a perimeter of the visor and secured by said second seam forming a second channel enclosing a second section of a loop membrane and forming an attachment area co-linear with said first channel;

a collapsible area formed by said loop membrane wherein the visor is twisted and folded under the crown such that the cap can be collapsed into said compacted form.

2. The cap of claim 1 wherein said membrane is one continuous length of element.

3. The cap of claim 1 wherein said membrane is the attachment of two lengths of element.

4. The cap of claim 1 wherein said collapsible frame collapses into a semi-concentric compact form.

5. The cap of claim 1 wherein said cap is a baseball cap.

6. The cap of claim 1, wherein said membrane also provides a retractable frame.

7. The cap of claim 6, wherein said retractable frame allows the cap to return to a recognizable cap form from said compacted form.

8. The cap of claim 7, wherein said retractable frame allows the cap to return to a recognizable baseball cap form from said compacted form.

9. The cap of claim 1, wherein said collapsible frame is compacted and secured by a containing device.

10. The cap of claim 9, wherein said containing device is a zippered pouch.

11. The cap of claim 1 wherein said visor is parabolic shaped.

12. The cap of claim 1, wherein said crown further comprises an adjusting device to allow the cap to conform to different sizes of a human head.

13. The cap of claim 12 wherein said adjustable device is an elastic strap.

14. The cap of claim 12 wherein said adjustable device is a hook and loop type fastener.

15. The cap of claim 1, wherein the material of said cap is clothing fabric.

16. The cap of claim 15, wherein said clothing fabric is strengthened on the crown by a plurality of stitched areas beginning at said circumference and joining to each other at a central joining point on a peak area of said crown.

17. The method of collapsing a cap into a compact form, comprising the steps of:

providing a cap said cap including a hollow crown wherein said crown has a circumference forming a border for a material covering said cap, a first seam where said material is folded over at the circumference and secured by said first seam forming a first channel along the circumference enclosing a first section of a loop membrane, a visor in which a cutaway section of said visor is attached to said circumference, a second seam wherein said material is folded over a perimeter of the visor and secured by said second seam forming a second channel enclosing a second section of a loop membrane and forming an attachment area co-linear with said first channel, and a collapsible area formed by said loop membrane wherein the visor is twisted and folded under the crown such that the cap can be collapsed into a compacted form;

folding and twisting the crown inwardly to a center of said crown thereby creating a layering area;

repeating the step of twisting and folding the crown;

twisting said visor at a central point along a longitudinal axis of said visor thereby creating two circular sections;

underlapping said circular sections to be semi-concentric with and contained within said layering area;

applying pressure to said layering area thereby creating a compact form.

18. The method of claim 17 wherein said compact form conformably fits within a shirt or pants pocket.

19. The method of claim 17 further comprising the step of restraining said form with a containment device.

20. The method of claim 19 further comprising the steps of:

providing said membrane with a retractable frame removing said containment device from said form;

retracting said form to a programmed state; and thereby resuming the recognizable shape of a cap.

* * * * *